United States Patent [19]

Rehder

[11] 4,401,469

[45] Aug. 30, 1983

[54] MANUFACTURING CAST IRON WITH PRE-REDUCED IRON ORE PELLETS

[75] Inventor: John E. Rehder, Toronto, Canada

[73] Assignee: Microdot Inc., Darien, Conn.

[21] Appl. No.: 241,657

[22] Filed: Mar. 9, 1981

[51] Int. Cl.[3] ..... C22C 33/08; C21C 7/02

[52] U.S. Cl. ..... 75/130 R; 75/53; 75/58

[58] Field of Search ..... 75/130 R, 53, 58

[56] References Cited

U.S. PATENT DOCUMENTS

| | | | |
|---|---|---|---|
| 2,779,675 | 1/1957 | Vennerholm et al. | 75/130 |
| 2,855,336 | 10/1958 | Curry | 75/130 |
| 3,177,064 | 4/1965 | Bohm | 75/43 |
| 3,214,267 | 5/1963 | Stephens et al. | 75/43 |
| 3,278,299 | 8/1962 | Kessler et al. | 75/130 |
| 3,282,678 | 11/1966 | Melcher et al. | 75/41 |
| 3,556,772 | 1/1971 | Rausch et al. | 75/33 |
| 3,948,612 | 4/1976 | Schulten-Baumer | 29/187.5 |
| 4,063,944 | 12/1977 | Behring | 75/256 |
| 4,093,455 | 6/1978 | Pietsch | 75/256 |
| 4,148,627 | 4/1979 | Haley | 75/3 |
| 4,188,210 | 2/1980 | Bregi | 75/130 R |
| 4,224,064 | 9/1980 | Bilek | 75/130 R |

*Primary Examiner*—P. D. Rosenberg

*Attorney, Agent, or Firm*—Lyman R. Lyon

[57] ABSTRACT

Cast iron having more regular and uniform free graphite particle shape and distribution is more reliably produced by using pre-reduced iron pellets as a major component of the melting stock. Cast iron made in this way may be advantageously used to form ingot molds, brake discs, and other products.

3 Claims, 2 Drawing Figures

Mag. X50.

Mag. X50.

MANUFACTURING CAST IRON WITH PRE-REDUCED IRON ORE PELLETS

BACKGROUND AND SUMMARY OF THE INVENTION

Cast iron may be defined as an allow of iron with sufficient carbon to form eutectic on solidification. This minimum amount is about two percent by weight. Other elements, particularly silicon, are invariably present in commercial cast irons. Under certain conditions of cooling rate and other element composition, part or all of the carbon dissolved in a molten alloy will precipitate during or after solidification as particles of free graphite. These particles can be observed on a polished surface of the iron using a magnification of about 50 times or more.

When no free graphite is precipitated on solidification the resulting cast iron is called "white" iron and is very hard, abrasion resistant, and brittle because all of the carbon is present as a very hard compound, iron carbide. If free graphite is present as tiny flakes the iron is called "gray" iron which is machinable and is widely used industrially. If the free graphite is present as tiny, nearly perfect spheres the iron is called "ductile" or "nodular" iron and it is machinable, of higher strength than gray iron, and is ductile or deformable without fracture.

A third type of iron containing free graphite is malleable iron, wherein the graphite is in finely dispersed compact masses called "temper carbon" which is formed only upon heat-treating a cast iron that has solidified as a white iron free of graphite.

Flakes of graphite interrupt the continuity of the metallic matrix, which is essentially that of a steel, and decrease its ductility to nearly zero and divide its tensile strength by a factor of about three. However, the positive attributes of better machinability, better wear resistance, better heat resistance, and lower modulus of elasticity are thereby created.

If the free graphite is present not as flakes but as minute irregular masses, as in malleable iron, the machinability is excellent but tensile strength, ductility, and modulus of elasticity are increased to 70 to 80 percent of those of steel with the same matrix. If the free graphite is present as well-defined smooth spheroids, as in ductile or nodular iron, strength and particularlity ductility are increased still further.

There is an intermediate structure of free graphite called "vermicular" or "compacted", which is part way between flakes and smooth spheroids. The mechanical properties are midway between those of flake graphite iron and of ductile iron. These relationships are described, for example, in a report entitled "Relation Between Mechanical Properties and Graphite Structure in Cast Irons" by Ruff and Doshi in "Modern Casting", June, July and August, 1980.

The essential point is that the mechanical and physical properties of the various types of cast iron are strongly affected by the amount, shape and distribution of the free graphite present. For a particular service, a particular combination of properties is optimum, and the iron to reliably have these properties must be produced to consistently have the necessary causative microstructure.

Control of the shape and distribution of free graphite particles has been by changes in processing conditions, such as solidification rate, and in chemical composition, for example use of elements such as silicon and sulfur. Very small amounts of a wide range of other elements can have major effects on graphite morphology. For example, the presence of 0.02 percent of magnesium in the molten iron can cause the graphite to precipitate as spheres on solidification; but the presence of 0.002% of lead will prevent this effect. The mechanism by which these effects occur is not understood, but the technology is well enough known from experience for most practical purposes. Since theory is not clear nor agreed upon, in various circumstances it is not possible to predict an effect, or to clearly explain an observed effect. There is, therefore, a considerable element of empiricism in the important question of control of free graphite shape in the various cast irons.

Another factor in the structure and properties of the cast irons is the relative amounts of ferrite and pearlite which constitute the metallic matrix in which the graphite particles are embedded. Ferrite is iron which is free of carbon except for a very small dissolved amount, and so is soft, relatively low in strength, and very malleable or ductile. Pearlite is iron in which thin parallel plates of iron carbide are embedded, so that a grain of pearlite is three or four times as strong as ferrite, is harder, and considerably less malleable. Grains of pearlite and of ferrite are intermingled, the total being 100 percent of the metallic matrix, and the relative proportions strongly affect the hardness, strength, and ductility of the iron as a whole, independently of free graphite embedded.

Pearlite is formed by a solid state transformation during cooling of the iron through the temperature range of approximately 820 to 700 degrees C. The amount formed, from 0 to 100 percent of the matrix, is a function of cooling rate and iron composition, particularly silicon content, and also of the amount and distribution of free graphite present. Structures other than pearlite or ferrite can be formed such as martensite though these are not germane to the present development. The quantitative effects of cooling rate and composition, particularly major elements such as silicon and manganese, are well established. However, very small quantities of elements such as antimony can have strong effects on the amount of pearlite formed, and the quantitative effects of a wide range of trace elements are not known. In this respect the state of lack of knowledge is similar to that concerning graphite particle shape, although there is no necessary connection between the two phenomena.

Cast irons normally contain a long list of elements in trace amounts from 0.001 to 0.01 percent which originate in the ores from which the iron was originally smelted, and from remelted scrap which contains contaminants. The effects of these elements on the shape of graphite particles and on pearlite formation, to the extent where experience does not exist and theory cannot explain, is called the "heredity effect". It is a real condition which is present to a greater or lesser extent and which in some cases can have a large or even controlling effect on microstructure. The presence of these elements may explain why many cast irons will possess a graphite flake structure that is a mixture of types.

As noted above a wide range of combinations of mechanical and physical properties of the cast iron is possible by suitably adjusting the amount of free graphite in the iron, its particle shape and distribution, and the nature of the steel-like matrix in which it is embedded.

For example, for making ingot molds into which molten steel is cast to solidify before being rolled or forged, it was found long ago that the best material is a flake gray cast iron with a large amount of graphite flakes (in the range of 3.6 to 4.5 percent total carbon content by weight, silicon in the range of about 1.0 to 2.5 percent, and manganese in the range of about 0.30 to 1.5 percent by weight) embedded in a matrix of mixed pearlite and ferrite, mostly ferrite. Experience has also shown that service life of molds is increased if the graphite flakes are more uniform in size and shape and are randomly distributed. It is believed that this is due to the lower modulus of elasticity thereby conferred. However, it is difficult and uncertain with the raw materials generally available to reliably and economically make a high carbon gray iron with graphite flakes in such favorable distribution.

Ingot molds have been made of ductile iron but have not been commercially successful since their increased cost is not accompanied by sufficiently increased service life. Malleable iron is not suitable for ingot molds since it cannot be made in the heavy section thicknesses necessary.

It has been discovered and published that if ingot molds are made of cast iron with vermicular or compacted graphite, their service life is much improved and they are now an article of commerce. There is no agreed explanation of the connection between microstructure and service life, but it is important that the graphite distribution be vermicular as defined by industry standards, with as little flake graphite or spheroidal graphite as possible. Such iron is peculiary difficult to consistently or reliably make, since the graphite structure is a midway point between flake and spheroidal achieved by addition of an optimum amount of special alloys including usually magnesium. The effect of other elements of composition and of "heredity" as noted above are particularly strong and therefore hard to predict and control.

Heretofore the raw materials from which commercial cast iron has been made have been remelted pig iron from blast furnaces, remelted iron and steel scrap, or their mixtures. Due to variations in composition of ores used and variations in blast furnaces operating practices, pig irons are known to vary considerably in the type and distribution of graphite flakes for the same composition and this follows through on remelting; and for obvious reasons there is considerable variation in remelted scrap because of adventitious other elements brought in. Such remelted irons, i.e. cast iron generally produced, are not easy to make with predictable structures and generally depend on known experiences with materials from known sources.

Pre-reduced iron is being produced in increasing quantities for making steel in arc furnaces, but very little has been available on the open market. It is characterized by being made from iron ore without reaching or even approaching the molten state. Limited experimental trials have been using pre-reduced iron to replace steel scrap in making cast iron, as reported for example in "Melting Prereduced Iron Ore Pellets in the Cupola" by Hofner et al, Transactions American Foundrymen's Society Vol. 76 (1968) page 53. However, to my knowledge there has been no commercial usage of it to make cast iron.

In order to determine suitability of pre-reduced iron pellets for making cast iron on a commercial scale, I initiated experiments in melting rate, losses, power consumption, and other production data and had test slabs cast to check on the mechanical properties of the cast iron made. On examining the microstructures of test bars, I discovered to my surprise that the graphite flakes were unusually straight, uniform, and free of mixed structure, and the pearlite content of the matrix was much lower than would be expected from the chemical corporation. Detailed comparison was then made of structure and mechanical properties of these samples and of samples taken from ingot molds of nearly identical composition made directly from blast furnace iron. This showed clearly the marked improvement accompanying the use of the pre-reduced iron as raw material. To my knowledge, this effect has not been previously known and I have found no reference to it in the literature. I believe it to be connected with the fact that the raw material has not been previously melted, but detailed explanation is not currently possible.

The advantages of the more uniform graphite distribution in the cast iron microstructure are at least two: One is that the more uniform geometry will give a lower modulus of elasticity to the iron especially at high carbon content, and this has been shown by comparative measurement. This property is of particular importance in products such as ingot molds and brake discs, in ingot molds probably increasing their service life by increasing their resistance to cracking.

A second advantage is that a base iron with such a propensity to cleanly defined graphite shapes will not only give a more reproducible gray iron structure, but will provide a more constant base for reproducible vermicular graphite structure upon suitable special alloy additions.

The increased proportion of ferrite to pearlite is mainly of economic importance in that it permits the use of decreased silicon content to arrive at a desired final ferrite content.

In summary, it is the purpose of my invention to improve the control which may be exercised over the microstructure of cast iron produced commercially in the foundry so that more uniform, clean, regular graphite particle shapes and distribution may be more reliably produced either in basic microstructures or in intentionally altered structures such as nodular cast iron or compacted graphite iron having a vermicular type microstructure. A more specific object is to improve the microstructure of ingot molds and other products made of cast iron.

This is accomplished by melting a charge composed largely of pre-reduced iron pellets to produce a cast iron containing approximately 3.6 to 4.5 percent total carbon content for heat resistant cast irons and 2.5 to 4.0% total carbon for other applications.

DESCRIPTION OF THE INVENTION

As indicated above, it is desirable to increase the uniformity of graphite flake distribution in gray cast iron to reliably produce cleaner, more uniform graphite spheres in nodular cast iron, to increase the consistency with which intermediate graphite structures (such as vermicular) can be produced, and to increase the ratio of ferrite to pearlite for a given composition. In accordance with my invention, control of these factors is improved or achieved by making the cast iron primarily from pre-reduced iron pellets.

Figure 1:
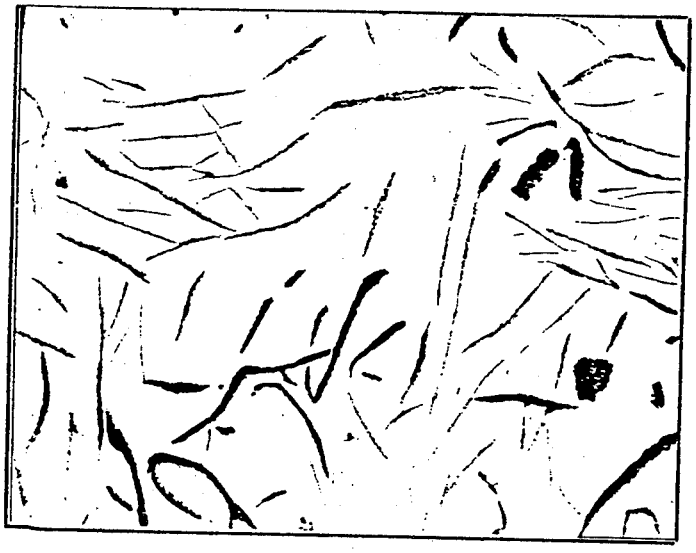
FIG. 1 is a photomicrograph at 50× showing the graphite distribution in iron produced by the present invention in a particular instance.

My invention is illustrated by the following example in which cast iron having the structure shown in FIG. 1 was produced in a 22 ton (metric) coreless induction furnace with a silica lining. The materials charged comprised about 92% pre-reduced iron pellets, about 3% ferrosilicon, about 4% carbon, and about 1% slag thickener. The procedure was to add carbon and ferrosilicon to the bath and then batch charge the pellets. The slag thickener was added just before the slag grab. Bath temperature for melting was about 1350° C. This would ordinarily be the pouring temperature; but in the specific example some superheating at pouring was used to avoid skulling in a relatively small ladle. The iron melt was poured at about 1390° C. from the ladle into sand molds to produce test slabs from which smaller slabs were trepanned for test purposes and microstructure determination. Iron composition of the sample was about 3.88 C, 1.41 Si, 0.66 Mm, 0.36 P, 0.007S, balance Fe. Average composition of the iron tapped throughout the run was 3.96%C and 1.70% Si.

The pre-reduced iron pellets were reduced from iron ore and were about 1.0 to 1.5 centimeters in diameter. Pellet composition was about the following: Fe (total) 89.5%; Fe (metallic) 75.0%; C 2.9% gangue or insolubles 4.6%, and minor amounts (totaling less than 1%) of P, S and MnO. Residual FeO in the pellets was about 18.6%. This was reduced to a large degree to Fe by carbon and/or silicon in the bath. No erosion of the furnace lining was visible.

Figure 2:
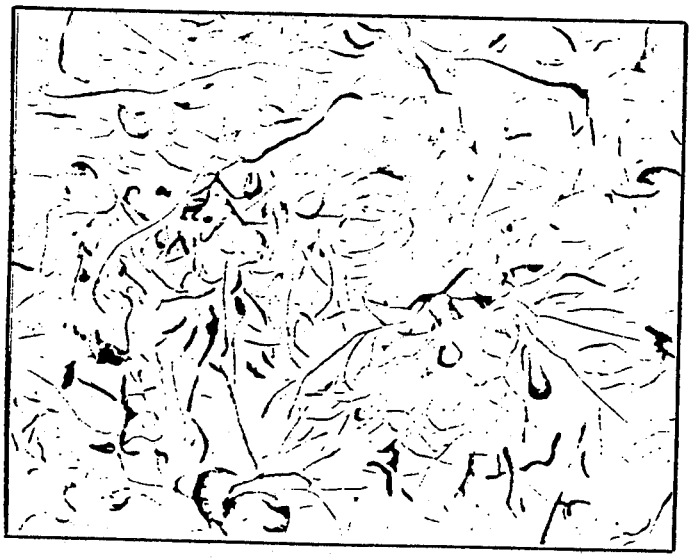
FIG. 2 is a photomicrograph at 50× showing the graphite distribution in an iron comparable to that of FIG. 1 but produced by use of hot metal directly from a blast furnace.

This process produced the structure shown in FIG. 1. FIG. 2 shows the structure of an iron of similar chemical composition and similar pouring temperature also cast into the same size test slabs. In this case the iron was molten blast furnace iron from a nearby blast furnace. The primary difference in manufacture between the irons of FIGS. 1 and 2 is the charge material. In addition to the marked visible distinction between the structures of FIGS. 1 and 2, a measurement of the amounts of ferrite and pearlite in the matrices of the respective test samples showed that iron made from pre-reduced iron of FIG. 1 had about 70–75% ferrite while the iron made from blast furnace melt had about 10–15% ferrite, balance pearlite and graphite. From other experience it is known that if steel scrap had been used as base iron in the electric furnace melt, the graphite distribution would be similar to that of the blast furnace iron and the amount of pearlite greater.

The distribution of flake graphite in the iron of FIG. 1 is surprisingly different from that of the iron of FIG. 2. Only minor differences would be expected since both irons came ultimately from clean iron ore, with no admixture of contaminants through use of scrap. The iron made from pre-reduced pellets (FIG. 1) has a remarkably uniform, clean, simple distribution of graphite flakes, such as one would see in a conception of ideal distribution. The iron made from blast furnace melt (FIG. 2) has a mixed graphite flake distribution, quite heterogeneous but typical of blast furnace irons. In addition, its matrix is almost entirely pearlite, which is undesirable in ingot molds, whereas the iron of FIG. 1 has only a minor amount of pearlite.

A trace element analysis of the two irons of FIGS. 1 and 2 revealed no significant difference between them. The mechanism at work to cause the difference in microstructure between the two is not known at this time. However, the basic cause is evidently the difference in raw charge material. The example is for a charge composed of substantially 100% pellets. It is likely that the desirable properties discussed will be diluted on a linear, proportional scale by substitution of scrap iron or steel or pig iron for some percent of the pellets.

When test bars for mechanical properties were compared, the iron of FIG. 1 from pre-reduced iron showed a modulus of elasticity of $9.5\times10^6$ psi and a tensile strength of 8,300 psi. The iron of FIG. 2 from blast furnace iron of nearly identical chemical composition showed a modulus of elasticity of $11.2\times10^6$ psi and a tensile strength of 13,800 psi.

The properties associated with FIG. 1 would likely give better performance in ingot molds, for example. To make ingot molds the melt made from pre-reduced iron pellets as described above with appropriate additions to increase carbon to the range of about 3.6 to 4.5%, silicon to the range of about 1.0% to 2.5%, and manganese to range of about 0.3 to 1.5% is poured into molds and allowed to solidify to form ingot mold castings having relatively uniform graphite structure corresponding to that of FIG. 1.

Variations may be made in the procedures set forth above without departing from the spirit and scope of my invention.

What is claimed:

1. A method of making iron castings of low elastic modulus characterized by a randomly distributed flake graphite morphology comprising the steps of, providing a melt charge comprising a. 90–95% of pellets having an approximate composition 75% Fe, 20% FeO, 2% C, 3% gangue, b. 3–5% ferrosilicon, c. 3–5% carbon, d. ±1% slag conditioners, melting said charge, and casting said melt.

2. A method according to claim 1 of achieving flake graphite morphology in iron castings in which the elastic modulus is held to approximately $10\times10^6$ psi.

3. A method of making iron castings according to claim 9 which comprises maintaining the melted material in a bath at a temperature of about 1350° C., reducing the FeO in the bath to Fe, adding C to the bath to increase the level of C in the bath to the range of about 3.5 to 4.5% C, adding Si to the bath to increase the level of Si to the range of about 1.0 to 2.5% Si, adding Mn to the bath to produce a range of about 0.30 to 1.5% Mn and, pouring the resultant melt into molds to form castings exhibiting uniform graphite flake particle distribution and a relatively low modulus of elasticity of approximately $9.5\times10^6$ psi.

* * * * *